United States Patent [19]

Chatani

[11] 4,375,139

[45] Mar. 1, 1983

[54] TOY ARRANGEMENT WITH INDEPENDENTLY ROTATABLE WHEEL MEANS

[75] Inventor: Yasushi Chatani, Tokorozawa, Japan

[73] Assignee: Kawada Co., Ltd., Tokyo, Japan

[21] Appl. No.: 382,564

[22] Filed: May 27, 1982

[30] Foreign Application Priority Data

May 28, 1981 [JP] Japan ..... 56-76522[U]

[51] Int. Cl.[3] ..... A63H 17/26; A63H 33/00

[52] U.S. Cl. ..... 46/221; 46/17

[58] Field of Search ..... 46/16, 17, 201, 221, 46/222, 223

[56] References Cited

U.S. PATENT DOCUMENTS

| | | | |
|---|---|---|---|
| 2,383,441 | 8/1945 | Beile | 46/223 |
| 2,398,223 | 4/1946 | Gilbert | 46/16 |
| 2,505,855 | 5/1950 | Foster | 46/221 |
| 2,577,702 | 12/1951 | De Twart | 46/17 |
| 2,596,957 | 5/1952 | Olson et al. | 46/16 |
| 3,032,919 | 5/1962 | Amsler | 46/17 X |
| 3,224,135 | 12/1965 | Wright et al. | 46/223 X |
| 4,164,090 | 8/1979 | Fischer | 46/201 X |

FOREIGN PATENT DOCUMENTS

| | | | |
|---|---|---|---|
| 1229855 | 3/1960 | France | 46/221 |

*Primary Examiner*—F. Barry Shay

*Attorney, Agent, or Firm*—Finkelstein & Tyson

[57] ABSTRACT

A rolling toy in substantially permanently assembled form including a body having retaining apertures therein receiving mounting blocks in fastened relation. The blocks include tubular axle members rotatably receiving individual wheels, the latter being held assembled by hub members having shafts received in the tubular axle members. Coupling means integral with the body allows serial connecting of plural toys. Mounting means may be provided on the body to detachably hold other parts thereon.

11 Claims, 16 Drawing Figures

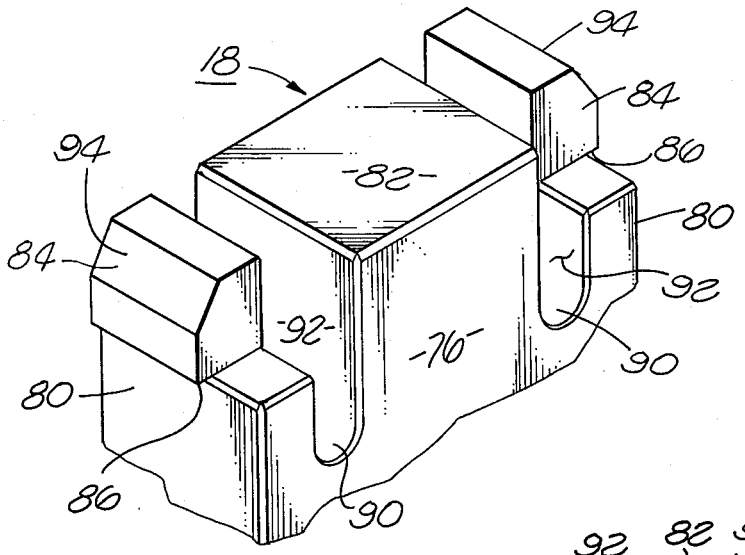
FIG. 7
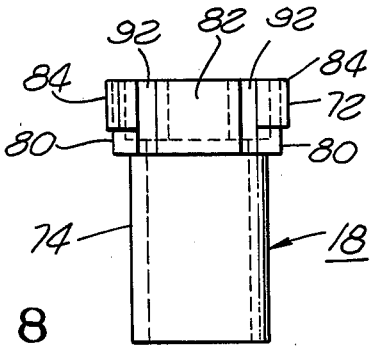
FIG. 8
FIG. 9
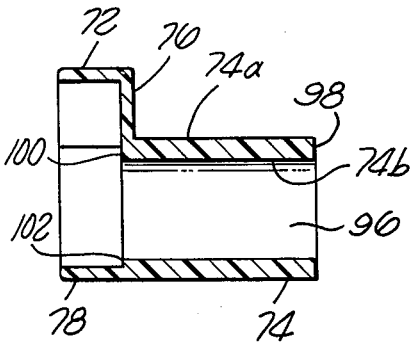
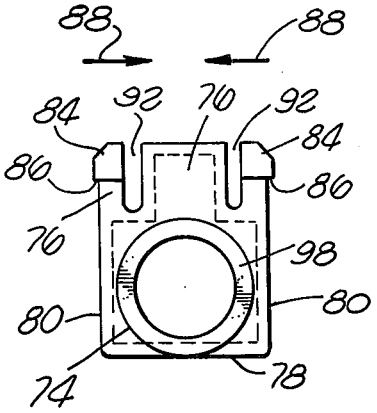
FIG. 10

TOY ARRANGEMENT WITH INDEPENDENTLY ROTATABLE WHEEL MEANS

BACKGROUND OF THE INVENTION

1. Field of the Invention

This invention relates to the toy art, and, more particularly, to an improved rolling toy of the type mounted on a plurality, such as four, wheels, and which may be rolled upon a surface.

2. Description of the Prior Art

Many varieties of rolling type toys for children of all ages have heretofore been utilized. However, in many instances, such toy arrangements have provided comparatively rigid axle members upon which pairs of wheels are rigidly attached so that the pairs of wheels may only be unitarily rotated. For example, in many of the prior art rolling toy arrangements, primarily designed for small children, the axles comprise a metal rod having knurled ends with the metal rod inserted through an appropriately sized aperture in the body of the rolling toy vehicle. The axle revolves freely in these apertures. Wheels are mounted on the axle for unitary rotation therewith, with the knurled ends of the metal rods comprising the axles retaining the wheels on the axle. The wheels are thus firmly fixed on the axle and thus both wheels may only turn unitarily with the axle. In such prior art rolling toy arrangements, attempts to rotate the wheels in opposite directions often cause the wheels to come off the axle and small children could be hurt by the then comparatively sharp end of the axle which becomes exposed when the wheels come off. Further, the play value of such a toy is limited, since the pairs of wheels may only unitarily rotate with the axle.

SUMMARY OF THE INVENTION

Accordingly, it is an object of the present invention to provide an improved rolling toy arrangement.

It is another object of the present invention to provide an improved rolling toy arrangement which allows a greater amount of play value for the enhanced enjoyment of the user.

It is another object of the present invention to provide a rolling toy arrangement in which each of the wheels thereof may be independently rotated.

It is another object of the present invention to provide an improved rolling toy arrangement in which the dangers to the user due to disassembly thereof, are eliminated.

It is another object of the present invention to provide an improved rolling toy arrangement in which there are no sharp objects exposed to the user.

It is yet another object of the present invention to provide an improved rolling toy arrangement in which the wheels are permanently mounted upon the body of the toy arrangement, and yet provide independent rotational capabilities.

It is still another object of the present invention to provide an improved rolling toy arrangement which is safer than prior art rolling toy arrangements for small children, which has increased play value, and which may be economically fabricated and assembled.

The above and other objects of the present invention are provided, in a preferred embodiment thereof, by having a body means which generally comprises the chassis of a rolling toy arrangement which is supported upon a plurality, such as four, rotating wheels. In such an embodiment, there are provided, on the body member, walls defining four retaining apertures. A mounting block means is insertable in each of the retaining apertures of the body means, and the mounting block means has a pair of tab portions which engage matching tab receiving shoulders in the retaining aperture for substantially permanent retention of the mounting block means on the body means. That is, without breaking either the body means or the mounting block means, the mounting block means cannot be removed from the retaining apertures of the body means after installation thereof.

The mounting block means also has an axle member extending outwardly from the body means, and the axle member may, for example, be a cylindrical tubular member.

A wheel means is rotatably mounted on the axle member of the mounting block means and is retained thereon by a hub means. The hub means has a disc-like flange member which engages the outer wall of the wheel means and a cylindrical insertion member which is inserted into the tubular cylindrical axle member of the mounting block means. The remote end of the insertion member, that is, the end spaced from the disc-like flange member, has a headed portion with at least a pair of engagement section means which engage head receiving shoulder surfaces of the axle member for substantially permanent retention of the hub means in the mounting block means. That is, without breaking either the mounting block means or the hub means, the hub means cannot be removed from the mounting block means after insertion therein. The flange member of the hub means thus retains the wheel means in its rotatably mounted condition upon the axle member of the mounting block means.

Each of the body means, the mounting block means, the hub means, and the wheel means, may be comparatively economically fabricated from, for example, an injection molded plastic.

The body means may, if desired, be provided with coupling means at oppositely disposed ends thereof, for detachably coupling together a plurality of similar body means. Additionally, the upper surface of the body means may comprise a plurality of mounting means for detachable mounting of additional structures onto the toy vehicle of the present invention.

BRIEF DESCRIPTION OF THE DRAWING

The above and other embodiments of the present invention may be more fully understood from the following detailed description, taken together with the accompanying drawing, wherein similar reference characters refer to similar elements throughout, and in which:

FIG. 7 is a partial perspective view of a mounting block means useful in the practice of the present invention;

FIG. 8 is a top plan view of the mounting block means useful in the practice of the present invention;

FIG. 9 is a sectional view of the mounting block means useful in the practice of the present invention;

FIG. 10 is an end elevational view of the mounting block means useful in the practice of the present invention;

DESCRIPTION OF THE PREFERRED EMBODIMENTS

Figure 1:
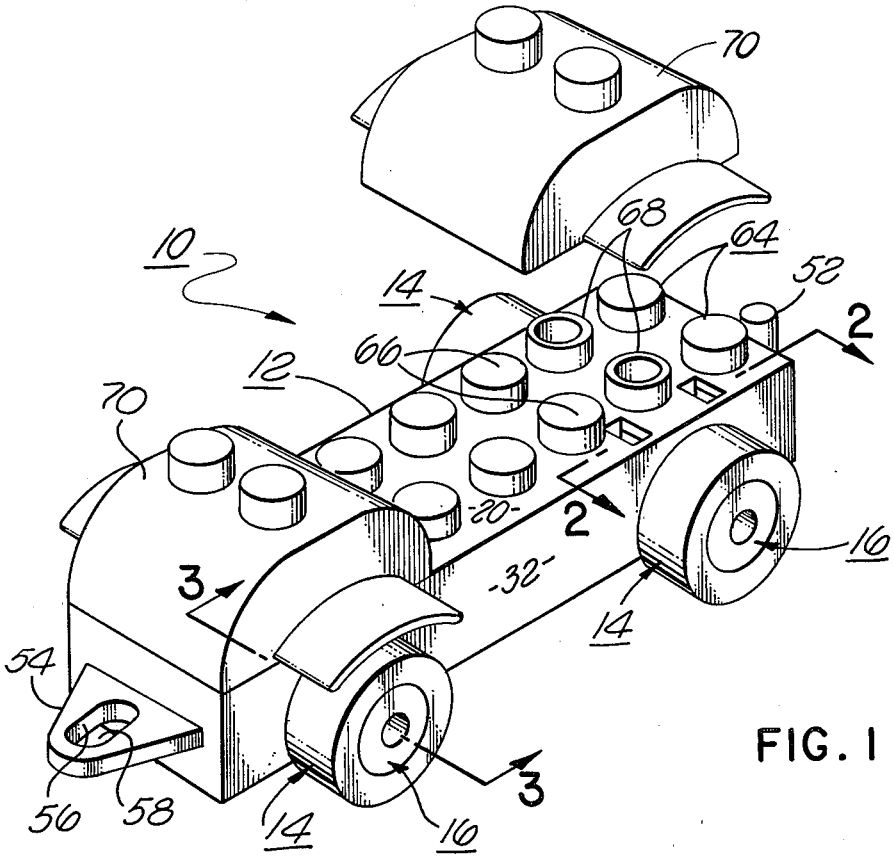
FIG. 1 is a perspective view of a preferred embodiment of the present invention.

Referring now to the drawing, and, in particular, to FIG. 1 thereof, there is illustrated a preferred embodiment, generally designated 10, of an improved rolling toy arrangement according to the principles of the present invention. The improved rolling toy arrangement 10 is generally comprised of a body means generally designated 12, upon which there are rotatably mounted four wheel means 14 (only three of which are visible in FIG. 1). Each of the wheel means 14 is retained on the body means 12 by a hub means 16, which is retained within a mounting block 18 (FIGS. 2 and 3), which is described below in greater detail.

Figure 4:
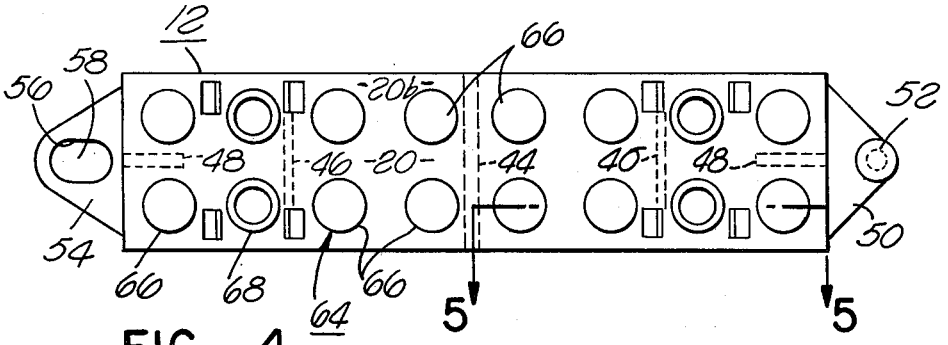
FIG. 4 is a top plan view of a body means useful in the practice of the present invention.
Figure 5:
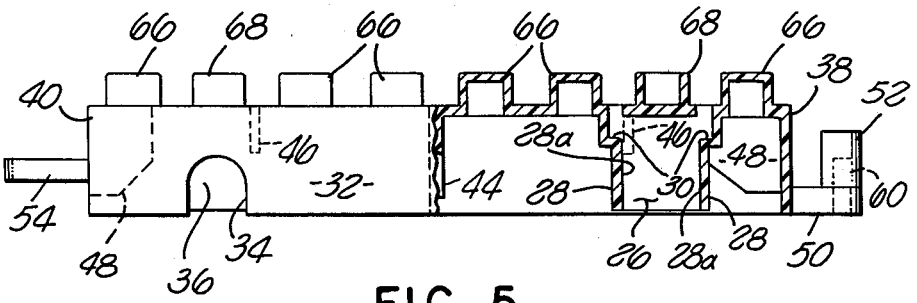
FIG. 5 is a side elevational view, partially in section, along the line 5—5 of FIG. 4 of the body means useful in the practice of the present invention.
Figure 6:
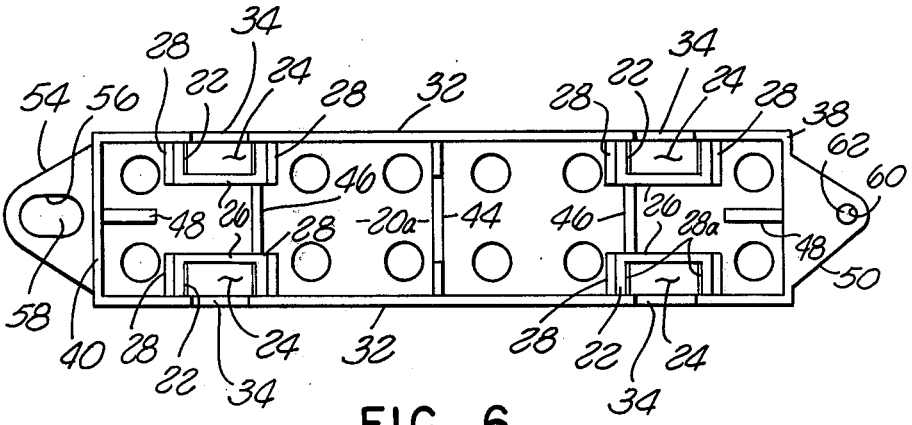
FIG. 6 is a bottom plan view of the body means useful in the practice of the present invention.

As may be more clearly seen from FIGS. 4, 5, and 6, the body means 12 generally comprises an upper wall 20, which, in the embodiment 10, is generally rectangular in shape. A plurality of wall members, generally designated 22, are coupled to the upper wall on the undersurface 20*a* thereof, and are downwardly dependent therefrom. The plurality of wall members 22 define a plurality of retaining apertures 24. The wall members 22 at each of the apertures 24, generally comprise inner wall portions 26 and a pair of oppositely disposed side wall portions 28. The side wall portions 28 are coupled to the adjacent inner wall portions 26, and extend a predetermined distance outwardly therefrom to thereby define the retaining apertures 24. Each of the side wall portions 28 have a tab receiving shoulder 30 thereon for purposes hereinafter described. The retaining apertures 24 are arrayed in two pair of aligned apertures to provide a total of four.

The body means 12 also comprises a pair of outer walls 32, coupled to the upper wall 20 and downwardly dependent therefrom. The outer walls 32 have wall sections 34 defining an axle receiving slot 36 in regions adjacent each of the retaining apertures 24.

A pair of end walls 38 and 40 are coupled to the upper wall 20 and are downwardly dependent therefrom, and extend between the side walls 32. If desired, one or more transverse main brace members 44 may be coupled to the lower surface 20*a* of the upper wall 20 and extend between the side walls 32 intermediate the pairs of aligned retaining apertures 24. Similarly, there may also be provided a pair of bracing members 46, extending between the inner wall portions 26 of each pair of aligned retaining apertures 24. The bracing members 46 are also coupled to the undersurface 20*a* of upper surface 20, and are downwardly dependent therefrom. A pair of end bracing members 48 may also be coupled to the undersurface 20*a* of the upper wall 20, one each in regions adjacent the end wall 38 and end wall 40. The pair of end bracing members 48, bracing members 46, and main brace member 44, provide structural rigidity to the body means 12.

A first coupling means 50 may be coupled to the first end wall 38, and may have an upstanding peg means 52, spaced from the end wall 38. A second coupling means 54, may be coupled to the second end wall 40, and may be provided with walls 56 defining a peg receiving aperture 58, into which the peg 52 of a similar body means 12 may be inserted for detachable coupling therebetween, so that a plurality of body means 12 may be thus detachably coupled together to be pulled along a surface during play thereof. If desired, walls 60, defining a hole 62 may be provided in the peg means 52, and extend through the first coupling means 50.

In order to enhance the play value of the present invention, there may be provided, on the upper surface 20*b* of upper wall 20 of body means 12, a plurality, as illustrated in FIGS. 4, 5, and 6, of sixteen mounting means 64, comprising twelve male mounting means 66 and four female mounting means 68. The mounting means 64 do not, per se, form a part of the present invention. As illustrated in FIG. 1, additional toy structures such as fender blocks 70 may be detachably mounted on the body means 12 by engagement with mounting means 64. The fender blocks 70 do not, per se, form a part of the present invention.

As illustrated particularly in FIG. 5, the interior surfaces 28*a* of each pair of side wall portions 28 in each retaining aperture 24 are in a predetermined spaced relationship. The tab receiving shoulders 30 have at least a portion thereof spaced further apart than the predetermined spaceing between the interior surfaces 28*a*, for purposes hereinafter described.

Figure 3:
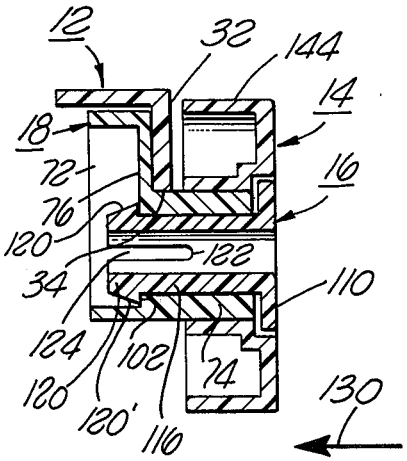
FIG. 3 is a sectional view along the line 3—3 of FIG. 1.
Figure 2:
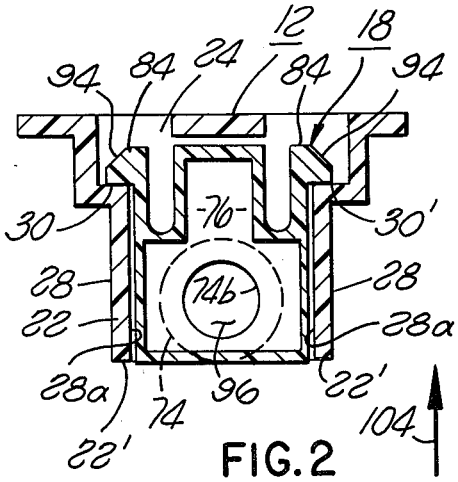
FIG. 2 is a sectional view along the line 2—2 of FIG. 1.

FIGS. 7, 8, 9, and 10, illustrate the mounting block means 18, one of which is positioned within and retained within each of the retaining apertures 24, as illustrated in FIGS. 2 and 3. Each of the mounting blocks 18 has a retainer member generally designated 72, and a generally tubular, cylindrical axle member 74. The retainer member 72 is generally rectangular in shape and is provided with an outer wall 76, a bottom wall 78, and a pair of spaced apart side walls 80. The retainer member 72 is also provided with a top wall 82. A pair of spaced apart tab portions 84 are provided on the retainer member 72 of mounting block means 18 in regions adjacent the top wall 82. The tab portions 84 are each provided with an engaging surface 86, and engaging surface 86 extends outwardly beyond the side wall 80. The tab portions 84 resiliently resist forces tending to force them together in the direction indicated by the arrows 88, and, to provide this resilience to such deformation, the retainer member 72 is also provided with walls 90, defining generally U-shaped channels 92 in regions adjacent each of the tab portions 84 for purposes hereinafter described.

In the preferred embodiment 10 of the present invention, each of the tab portions 84 has a chamfered wall 94. As described below in greater detail, the chamfered wall 94 facilitates the assembly of the mounting block 18 into the body member 12.

The axle member 74 has a generally cylindrical outer surface 74*a* and an inner surface 74*b* defining a hub receiving aperture 96 extending therethrough from the outer end 98 to the retainer member 72. Thus, a generally annular head receiving shoulder 100 is defined at the inner end 102, of the axle member 74.

As noted above, a mounting block means 18 is inserted in each of the retaining apertures 24 of the body means 12. Referring now particularly to FIG. 2, the mounting block means 18 is inserted into the retaining aperture 24 of the body means 12 from the direction indicated by the arrow 104. The lower ends 28' of each of the side wall portions 28, engage the chamfered wall 94 on the retainer member 72 of the mounting block 18 when insertion is commenced and force the tab portions 84 toward each other. An insertion is continued in the direction indicated by the arrow 104, the tab portions 84 slide against the interior surfaces 28*a* of the side walls 28 of each of the retaining apertures 24 until the engaging surfaces 86 on the tab portions 84 reach the tab receiving shoulders 30. At this point the forces tending to resiliently force the tab portions 84 toward each other are released and they spring out to the shape illustrated and thus the mounting blocks 18 are substantially permanently retained within the retaining apertures 24.

Figure 11:
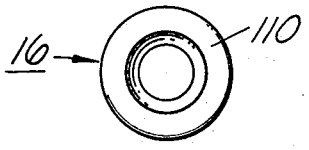
FIG. 11 is an end elevational view of a hub means useful in the practice of the present invention.
Figure 12:
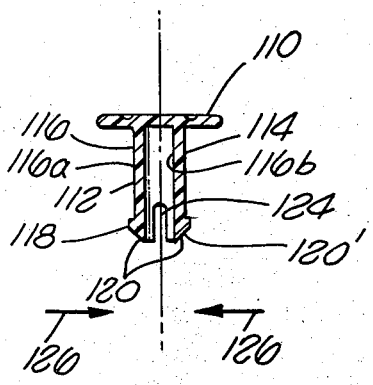
FIG. 12 is a sectional view of the hub means useful in the practice of the present invention.
Figure 13:
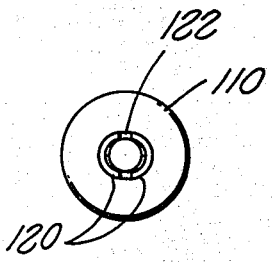
FIG. 13 is another end elevational view of the hub means useful in the practice of the present invention.

The hub means 16 is illustrated in greater detail in FIGS. 11, 12, and 13. As illustrated therein, the hub means 16 generally comprises a generally disc-like flange member 110, and a generally tubular insertion member 114. The tubular insertion member has a shaft portion 116, having a generally cylindrical outer surface 116*a* and an inner surface 116*b*. The diameter of the outer surface 116*a* is preselected to allow positioning of the insertion member 114 within the hub receiving aperture 96 of the mounting block 18. The insertin member 114 is provided with a headed portion 118, at the end remote from the disc-like flange member 110, and the headed portion 118 is provided with engagement section means 120, having a dimension greater than the predetermined outer diameter of the shaft portion 116 of the insertion member 114. In the embodiment 10, as illustrated in FIGS. 11, 12, and 13, the engagement section means 120 generally comprises two separate, spaced apart engagement sections, each of which form a portion of an oval whose minor diameter is substantially equal to the outer diameter of the surface 116*a* of the short portion 116, and whose major diameter is greater. The tubular shaft portion 116 is provided with walls 122 defining a slot 124 therein. The slot 124 provides a resiliently resisting movement of the engagement portions 120 toward each other when subjected to forces as indicated in the direction of the arrow 126. If desired, as illustrated particularly in FIG. 12, each of the engagement portions 120 may be provided with a chamfered wall section 120'.

Referring now to FIG. 3, the hub means 16 is inserted into the hub receiving aperture 96 of the axle member 74 of the mounting block means 18 in a direction indicated by the arrow 130. When insertion is commenced, the outer end 98 of the axle member 74 of the mounting block means 18 engages the chamfered wall 120' of the engagement section means 120 of the headed portion 118. This forces the engagement section means 120 toward each other in the direction indicated by the arrows 126 (FIG. 12), and they continue to slide along the inner surface 74*b* defining the hub receiving aperture 96, until the engagement section means 120 reaches the annular head receiving shoulder 102. At this point, the forces tending to force the engagement section means 120 toward each other are released and they spring apart, allowing the engagement section means 120 to abut on the annular head receiving shoulder 102. Thus, the hub means 16 is substantially permanently retained within the mounting block 18.

As shown on FIG. 3, the wheel means 14 is rotatably mounted on the cylindrical tubular axle member 74 of the mounting block means 18, between the disc-like flange member 110 of the hub means 16 and, in the embodiment 10, outer wall 32 of the body means 12.

Depending upon the particular application, the hub means 15 may rotate within the hub receiving aperture 96 of the mounting block means 18, or may be prevented from such rotation by a frictional engagement therebetween. Additionally, as can be seen from FIG. 3, there is sufficient axial clearance between the disc-like flange member 110 of the hub means 16 and the outer wall 32 of the body means 12, so that the wheel means 14 may rotate freely.

Figure 14:
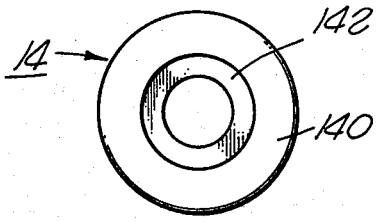
FIG. 14 is an end elevational view of a wheel means useful in the practice of the present invention.
Figure 15:
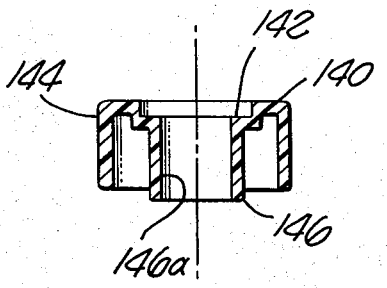
FIG. 15 is a sectional view of the wheel means useful in the practice of the present invention.
Figure 16:
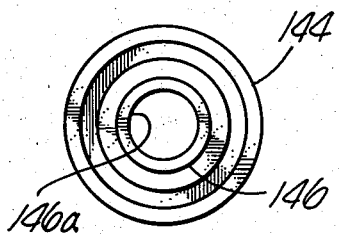
FIG. 16 is another end elevational view of the wheel means useful in the practice of the present invention.

FIGS. 14, 15, and 16 illustrate the wheel means 14 of the preferred embodiment 10. The wheel means 14 generally comprises an outer wall 140, having a flange receiving surface 142 therein, for receiving the flange member 110 of the hub means 16, as illustrated in FIG. 3. Thus, the axial depth of the flange receiving surface 142 is substantially equal to the axial thickness of the flange member 110. A cylindrical peripheral wall 144 is coupled to the outer wall 140, and extends axially a predetermined distance. The generally tubular cylindrical inner wall 146 is coupled to the outer wall 140 and extends axially therefrom in the same direction as the cylindrical peripheral wall 144. In preferred embodiments of the present invention, the axial extent of the tubular cylindrical inner wall 146 is greater than the axial extent of the cylindrical peripheral wall 144. The inner surface 146*a* of the tubular cylindrical inner wall 146 engages the outer surface 74*a* of the axle member 74 of the mounting block means 18 for rotational mounting of the wheel means 14 thereon.

Each of the body means 12, wheel means 14, hub means 16, and mounting block means 18, may be unitarily fabricated of a molded plastic. Thus, because of the substantially permanent retention of the mounting block means 18 within the body means 12, and of the hub means 16 within the mounting block means 18, the wheel means 14 cannot be removed from the assembly without substantial breaking or destruction of one or more of the components thereof. This prevents injury to, for example, comparatively small children for whom the rolling toy arrangement of embodiment 10 is designed. Further, because of the unique construction, each of the wheel means 14 is independently rotatable with respect to any of the other wheel means 14.

Having thus described a preferred embodiment of the present invention, it will be appreciated by those skilled in the art that many variations and adaptations thereof may be made and the appended claims are intended to cover all such variations and adaptations falling within the true scope and spirit of the present invention.

What is claimed is:

1. An improved rolling toy arrangement comprising, in combination:

a body means, said body means having:

an upper wall; and a plurality of wall members coupled to said upper wall and dependent therefrom, and defining a plurality of retaining apertures; and said wall members comprising: inner wall portions; and a pair of oppositely disposed side wall portions coupled to said inner wall portions, and extending a predetermined distance outwardly therefrom; and each of said side wall portions in each of said plurality of retaining apertures having a tab receiving shoulder thereon;

a plurality of mounting block means, each of said mounting block means having:

a retainer member; and an axle member coupled to said retainer member and extending outwardly therefrom;

said retainer member in one of said plurality of said retaining apertures of said body means, and said retaining member having:

a pair of spaced apart tab portions and each of said tab portions having an engaging surface engaging said tab receiving shoulders of said side wall portions of said retaining apertures for retention of said mounting block means in said retaining apertures of said body means; and said pair of tab portions of said mounting block means resiliently resisting deformation toward each other; and said axle member tubular in cross section and having:

a substantially cylindrical outer surface; and an inner surface defining a hub receiving aperture extending therethrough; and said axle member having a head receiving shoulder at said retainer member;

a hub means having:

a disc-like flange member; and an insertion member extending from said flange member, and said insertion member having:

a shaft portion having a predetermined outer dimension; and a headed portion spaced from said flange member, and said headed portion having at least:

an engagement section means thereof having a dimension greater than said predetermined outer dimension of said shaft portion of said insertion member; and said insertion member of said hub means positioned in said hub receiving aperture of said mounting block means and said engagement section means of said headed portion engaging said head receiving shoulder of said axle member of said mounting block means for retention of said hub means therein; and a wheel means rotatably mounted on said axle member of said mounting block means and having:

a flange engaging surface for engaging said disc-like member of said hub means for retaining said wheel means on said axle member of said mounting block means.

2. The arrangement defined in claim 1, wherein said body means further comprises:

a pair of spaced apart outer wall members coupled to said upper wall and downwardly dependent therefrom and spaced said predetermined distance outwardly from said inner wall portions of said retaining apertures, and said pair of spaced apart outer wall members having walls defining an axle receiving slot therethrough in regions adjacent each of said plurality of retaining apertures;

said side wall portions of each of said retaining apertures having interior surfaces in a predetermined spaced relationship, and said tab receiving shoulders of said side wall portions having sections spaced greater than said predetermined spacing between said interior surfaces;

said axle member of said mounting block means positioned in said axle receiving slot.

3. The arrangement defined in claim 2, and further comprising:

said upper wall of said body means is quadilateral;

a pair of end walls coupled to said upper wall and dependent therefrom, and extending between said pair of spaced apart outer wall members;

first coupling means coupled to the first of said end walls and second coupling means coupled to the second of said end walls; and said tab receiving shoulders of said retaining apertures are spaced downwardly from said upper wall of said body means.

4. The arrangement defined in claim 3, wherein said first coupling means further comprises a peg means spaced from said end wall and said second coupling means further comprises walls defining a peg receiving slot whereby the peg means of one body member may be inserted in said peg receiving slot of a similiar body member for detachable mounting therebetween.

5. The arrangement defined in claim 4, wherein the number of said plurality of said retaining apertures is four;

a first and a second of said retaining apertures in an aligned relationship;

a third and a fourth of said retaining apertures spaced from said first and said second retaining apertures, and said third and fourth retaining apertures in an aligned relationship; and a pair of bracing members coupled to said upper wall of said body means and extending downwardly therefrom and a first of said bracing members extending between said first and said second retaining aperture and a second of said pair of bracing members extending between said third and said fourth retaining apertures;

a main bracing member coupled to said upper wall and extending downwardly therefrom, and extending between said pair of spaced apart outer wall members and positioned intermediate said aligned pairs of retaining apertures; and a pair of end bracing members coupled to said upper wall and extending downwardly therefrom, and a first of said pair of end bracing members coupled to a first of said pair of end walls and a second of said pair of end bracing members coupled to the second of said pair of end walls; and a plurality of mounting means coupled to said upper wall of said body means and extending upwardly therefrom in a direction opposite to the direction of said wall portions defining said retaining apertures.

6. The arrangement defined in claim 2, wherein said engaging surfaces of said tab portions of said mounting block means are spaced apart a distance greater than said predetermined spaced relationship of said interior surfaces of said side wall portions of said retaining apertures of said body means.

7. The arrangement defined in claim 6, wherein said mounting block means further comprises:

said retainer member having walls defining a substantially U-shaped slot in regions adjacent each of said tab portions for providing said tab portions resiliently resisting deformation toward each other; and said axle member of said mounting block means comprising a cylindrical tubular member.

8. The arrangement defined in claim 2, wherein said hub means further comprises:

said shaft portion of said insertion member of said hub means comprises a substantially right cylindrical tubular member;

said engagement section means of said headed portion of said insertion member comprises two spaced apart engagement section means disposed in diametrically opposite relationship;

said insertion member further comprises walls defining a slot means in regions adjacent said engagement section means, and said slot means extending from said engagement section means toward said disc-like flange member;

said two spaced apart engagement section means resiliently resisting deformation toward each other.

9. The arrangement defined in claim 8, wherein:

each of said engagement section means comprises portions of an oval and the minor diameter of said oval is substantially equal to the outer dimension of said insertion member and the major diameter of said oval comprises a dimension larger than said predetermined outer dimension of said insertion member, whereby said engagement section means is retained on said head receiving shoulder of said axle member of said mounting block means.

10. The arrangement defined in claim 2, wherein said wheel means further comprises:

an outer wall, and said outer wall having said flange engaging surface thereon;

a substantially cylindrical peripheral wall, coupled to said outer wall and extending axially therefrom; and a tubular inner wall coupled to said outer wall and extending axially therefrom, and said tubular inner wall concentrically aligned with said cylindrical peripheral wall; and the inner surface of said tubular inner wall rotatably mounted on said tubular axle member of said mounting block means.

11. The arrangement defined in claim 10, wherein said wheel means further comprises:

said flange engaging surface of said outer wall of said wheel means is spaced axially from the outer surface of said outer wall a distance substantially equal to the thickness of said flange member of said hub means; and said tubular cylindrical inner wall of said wheel means extends axially from said outer wall a greater distance than said cylindrical peripheral wall of said wheel means.

* * * * *